US006140642A

United States Patent [19]

Kaneyama et al.

[11] Patent Number: 6,140,642

[45] Date of Patent: Oct. 31, 2000

[54] IMAGING ENERGY FILTER EQUIPPED WITH DISTORTION CORRECTOR

[75] Inventors: Toshikatsu Kaneyama; Toshikazu Honda, both of Tokyo; Michiyoshi Tanaka, 28-4, Yagiyama-honcho 2-chome, Taihaku-ku, Sendai, 982-0801; Masami Terauchi, Sendai; Kenji Tsuda, Sendai, all of Japan

[73] Assignees: Jeol Ltd.; Michiyoshi Tanaka, both of Japan

[21] Appl. No.: 09/259,082

[22] Filed: Feb. 26, 1999

[30] Foreign Application Priority Data

Feb. 26, 1998 [JP] Japan ..... 10-045459

[51] Int. Cl.[7] ..... H01J 49/46

[52] U.S. Cl. ..... 250/305; 250/396 ML

[58] Field of Search ..... 250/305, 396 ML, 250/311, 310, 396 R

[56] References Cited

U.S. PATENT DOCUMENTS

| | | | |
|---|---|---|---|
| 4,851,670 | 7/1989 | Krivanek | 250/305 |
| 5,448,063 | 9/1995 | De Jong et al. | 250/305 |
| 5,449,914 | 9/1995 | Rose et al. | 250/396 |
| 5,952,656 | 9/1999 | Kaneyama | 250/305 |

*Primary Examiner*—Kiet T. Nguyen
*Attorney, Agent, or Firm*—Webb Ziesenheim Logsdon Orkin & Hanson, P.C.

[57] ABSTRACT

There is disclosed an imaging energy filter equipped with a distortion corrector. The energy filter is incorporated in an electron microscope and includes a spectrometer having magnets for producing magnetic fields. In this spectrometer, coils for exciting the magnets and potentiometers having variable resistors are connected in parallel. The variable resistors of the potentiometers are shifted to control the ratio of currents flowing into coils of shunting circuits.

5 Claims, 7 Drawing Sheets

IMAGING ENERGY FILTER EQUIPPED WITH DISTORTION CORRECTOR

FIELD OF THE INVENTION

The present invention relates to an imaging energy filter having at least three magnets arranged in plane symmetry to permit only incident electrons which have a certain energy to exit from the filter.

DESCRIPTION OF THE PRIOR ART

Electron microscopes having electron optics in which an Omega energy filter is incorporated have been developed. This microscope is shown in FIG. 5 and generally indicated by numeral 1. This microscope 1 has an electron gun 2 emitting a beam of electrons e. This beam is directed to a specimen 5 placed in an objective lens 4 via condenser lenses 3. The beam transmitted through the specimen 5 is projected onto a fluorescent screen 11 via the objective lens 4, an intermediate lens 6, an entrance aperture 7, a spectrometer 8, a slit 9 and a projector lens 10 to image the specimen.

An omega energy filter 12, incorporated in this electron microscope 1, includes the entrance aperture 7, the spectrometer 8 and the slit 9. As shown in FIG. 6, this spectrometer 8 has four magnets, or first through fourth magnets $M_1$, $M_2$, $M_3$ and $M_4$, which are arranged from the entrance side toward the exit side in this order. Of these four magnets, the first magnet $M_1$ and the fourth magnet $M_4$ are vertically spaced from each other and arranged symmetrically with respect to a symmetrical plane. Similarly, the second magnet $M_2$ and the third magnet $M_3$ are arranged symmetrically with respect to the symmetrical plane. The spectrometer 8 is so designed that a beam of electrons e having a certain energy can pass through the four magnets $M_1$, $M_2$, $M_3$ and $M_4$ in turn and that the outgoing beam is in line with the incident beam. In this way, an omega-shaped electron trajectory is formed.

To suppress distortion and astigmatism in this spectrometer 8, the geometries of the four magnets $M_1$, $M_2$, $M_3$ and $M_4$ are required to be designed very carefully such that they produce magnetic fields completely symmetrically with respect to the symmetrical plane and that the electron optical characteristics of the magnets are symmetrical vertically.

However, where the magnets $M_1$, $M_2$, $M_3$ and $M_4$ are machined and assembled in practice, the structure of the spectrometer inevitably quite slightly deviates from perfect vertical symmetry because of nonuniformity of the materials, machining errors and assembly errors. That is, perfect symmetry about the symmetrical plane shown in FIG. 6 cannot be achieved. Excitation currents for compensating for the vertical asymmetry of the strengths of magnetic fields produced by the magnets and for mechanical dimensional errors are required to be accurate within 0.1%. It is impossible to achieve this accuracy only with the magnets because of such slight asymmetry. As a result, distortion is induced in the spectrometer 8 and the astigmatism is increased.

One might contemplate preparing the same number of power supplies as the magnets and controlling the excitation currents independently to correct such slight asymmetry. In this case, the power supplies must be balanced accurately according to the distortion and astigmatism. Hence, it is difficult to control the power supplies. Furthermore, it is laborious to operate the instrument. In addition, it is unrealistic to control these power supplies completely and independently. Therefore, the power supplies must be interlocked and thus the circuit configuration is made complex. Moreover, the same number of power supplies as the magnets must be prepared. This increases the number of components, increasing the cost.

SUMMARY OF THE INVENTION

In view of the foregoing circumstances, the present invention has been made.

It is an object of the present invention to provide an imaging energy filter equipped with a distortion corrector which has a reduced number of power supplies to correct slight asymmetry of magnets to thereby facilitate control of interlocking operations between the power supplies. The imaging energy filter equipped with a distortion corrector is capable of achieving a simplified circuit configuration.

An imaging energy filter equipped with a distortion corrector for solving the aforementioned problems and built in accordance with a first embodiment of the present invention is for use with an imaging energy filter having at least three magnets arranged in plane symmetry. These magnets cause those of incident electrons which have a certain energy to exit from the filter. These magnets include at least one pair of magnets arranged in plane symmetry. Coils for exciting this pair of magnets are connected in series with each other at a junction and with a power supply. A potentiometer consisting of a variable resistor is connected in parallel with these coils. This potentiometer has a sliding contact connected with the junction of the coils connected in series, thus forming a shunting circuit.

An imaging energy filter equipped with a distortion corrector according to another embodiment is based on the imaging energy filter equipped with a distortion corrector of the first embodiment and further characterized in that the potentiometer is connected with the coils via first and second fixed resistors used to prevent overcurrents.

In these imaging energy filters equipped with distortion correctors constructed in accordance with the inventions as described above, the ratio of the currents flowing into their respective coils of the shunting circuit is varied by shifting the sliding contact of the potentiometer. This, in turn, changes the magnitude of the distortion of the image. At the same time, the relation between the direction of electrons incident on the spectrometer and the direction of electrons going out of the spectrometer varies. Accordingly, the ratio of the currents is controlled by varying the resistance of the potentiometer, thus correcting the distortion of the image. Also, the exit direction is corrected. These operations are repeated. In this way, the image distortion and the exit direction are accurately corrected.

Thus, correction of the image distortion and correction of the exit direction are achieved simultaneously by using fewer power supplies than magnets. Since the power supplies are fewer than the magnets, the power supplies can be balanced accurately and easily. Furthermore, it is not necessary to accurately control the interlocking operations between the power supplies. In addition, the circuit configuration is simplified.

Other objects and features of the invention will appear in the course of the description thereof, which follows.

DESCRIPTION OF THE PREFERRED EMBODIMENTS

Figure 1:
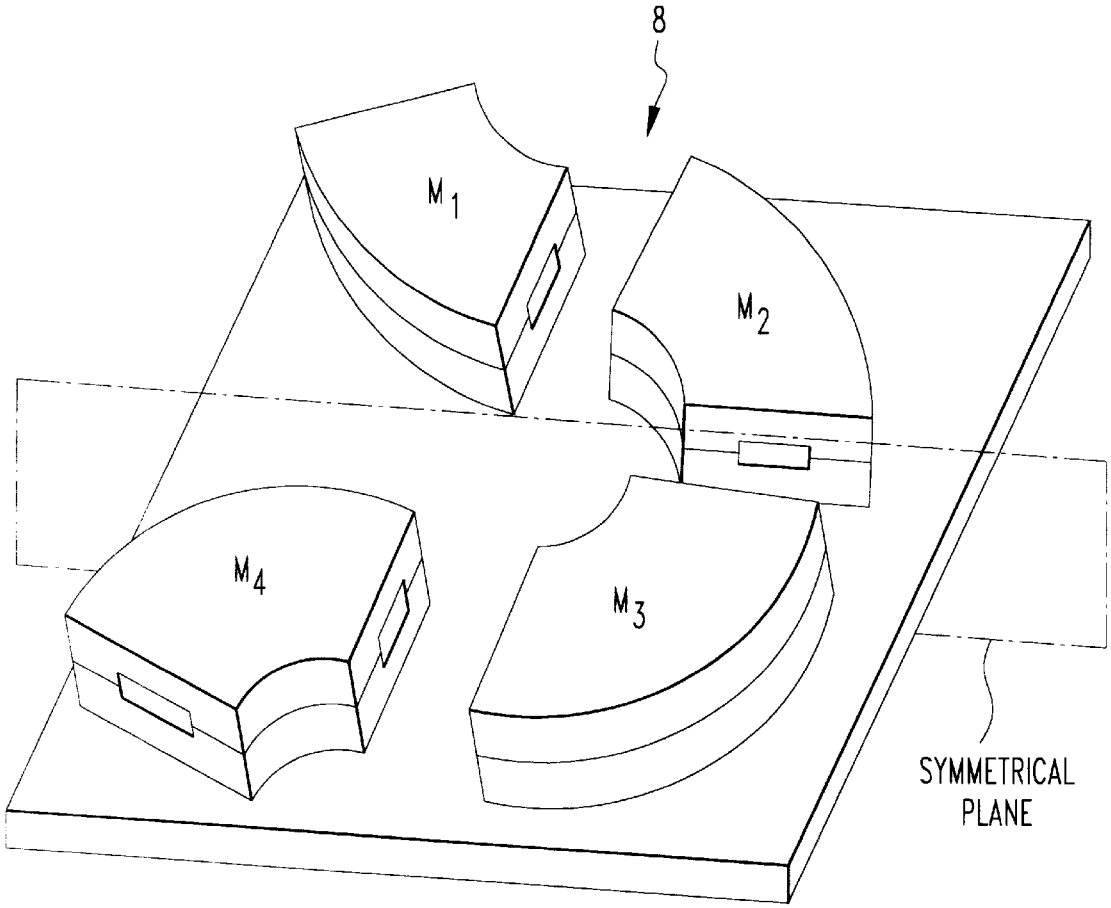
FIG. 1 is a perspective view of a spectrometer of an imaging energy filter for use with a distortion corrector in accordance with the present invention.
Figure 2:
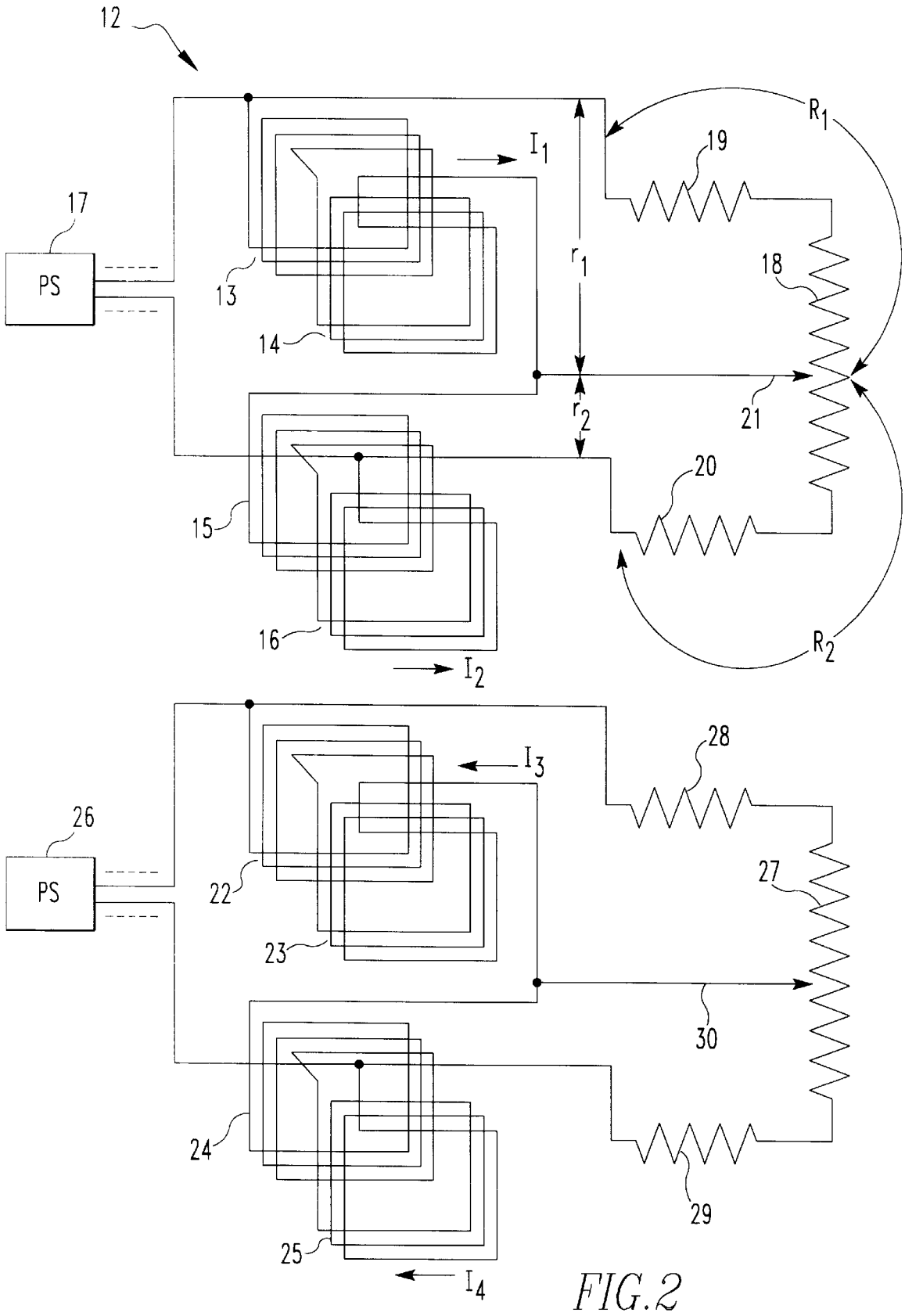
FIG. 2 is a circuit diagram of the spectrometer shown in FIG. 1.

FIG. 1 shows a spectrometer of an imaging energy filter with which a distortion corrector is built in accordance with the invention. FIG. 2 shows the circuit configuration of the spectrometer. Note that like components are indicated by like reference numerals in various figures.

As shown in FIG. 1, the spectrometer 8 has pairs of magnets $M_1$, $M_4$, $M_2$ and $M_3$. In the same way as in the prior art spectrometer described above, these magnets $M_1$, $M_4$, $M_2$ and $M_3$ are arranged symmetrically about the symmetrical plane within a range permitting machining errors. The magnets $M_1$ and $M_2$ are arranged symmetrically about the symmetrical plane. Also, the magnets $M_3$ and $M_4$ are arranged symmetrically about the symmetrical plane. Thus, an omega-shaped electron trajectory is formed.

As shown in FIG. 2, a first coil 13 and a second coil 14, forming a pair, are connected in series with each other for producing a magnetic field in the gap in the first magnet $M_1$. Similarly, a third coil 15 and a fourth coil 16, forming a pair, are provided to excite the fourth magnet $M_4$. One end of the second coil 14 is connected with one end of the third coil 15 and thus the two pairs of coils 13–16 are connected in series with each other. One end of the first coil 13 and one end of the fourth coil 16 are connected with a first power supply (PS) 17.

A first potentiometer 18 having a variable resistor is connected with the first power supply 17 and connected in parallel with the two pairs of coils 13–16. A first fixed resistor 19 and a second fixed resistor 20 for preventing overcurrents are located on opposite sides of the first potentiometer 18 and connected in series with the first potentiometer 18. That is, one end of the first potentiometer 18 is connected with one end of the first coil 13 via the first fixed resistor 19. The other end of the first potentiometer 18 is connected with one end of the fourth coil 16 via the second fixed resistor 20.

The first potentiometer 18 has a first sliding contact 21 connected with the junction of one end of the second coil 14 and one end of the third coil 15. The first potentiometer 18, the first fixed resistor 19 and the second fixed resistor 20 together form a shunting circuit that adjusts the balance between the currents flowing through the first and second coils 13, 14 and the third and fourth coils 15, 16, respectively.

Similarly to these two pairs of coils 13, 14, 15, 16, first power supply 17, first potentiometer 18, first fixed resistor 19, second fixed resistor 20 and first sliding contact 21, there are provided a pair of coils 22, 23 for exciting the second magnet $M_2$, a pair of coils 24, 25 for exciting the third magnet $M_3$, a second power supply (PS) 26, a second potentiometer 27, a third fixed resistor 28, a fourth fixed resistor 29 and a second sliding contact 30. The second potentiometer 27, the third fixed resistor 28, and the fourth fixed resistor 29 together form a shunting circuit for adjusting the balance between the currents flowing through the fifth and sixth coils 22, 23 and the seventh and eighth coils 24, 25, respectively.

In the spectrometer 8 constructed in this way, if the first sliding contact 21 of the first potentiometer 18 is shifted toward the first fixed resistor 19, the excitation current through the first magnet $M_1$ decreases, while the excitation current through the fourth magnet $M_4$ increases. If the first sliding contact 21 is shifted toward the second fixed resistor 20, the excitation current through the first magnet $M_1$ increases, whereas the excitation current through the fourth magnet $M_4$ decreases. When the resistance of the first potentiometer 18 is changed in this way, the balance between the strengths of the magnetic fields developed in the gaps in the first and fourth magnets $M_1$ and $M_4$ is subtly controlled. Similarly, the balance between the strengths of the magnetic fields set up in the second and third magnets $M_2$ and $M_3$ is controlled subtly by varying the resistance of the second potentiometer 27.

Let $r_1$ be the sum of the resistances of the first coil 13 and the second coil 14. Let $r_2$ be the sum of the resistances of the third coil 15 and the fourth coil 16. Let $R_1$ be the sum of the resistance of the first fixed resistor 19 and the resistance of the portion of the first potentiometer 18 between the first sliding contact 21 and the first fixed resistor 19. Let $R_2$ be the sum of the resistance of the second fixed resistor 20 and the resistance of the portion of the first potentiometer 18 between the first sliding contact 21 and the second fixed resistor 20. Let $I_1$ be the current flowing through the first coil 13 and the second coil 14. Let $I_2$ be the current flowing through the third coil 15 and the fourth coil 16. The ratio of the current $I_1$ to the current $I_2$ is given by $$\frac{I_1}{I_2} = \frac{1 + \frac{r_2}{R_2}}{1 + \frac{r_1}{R_1}} \tag{1}$$

Figure 3:
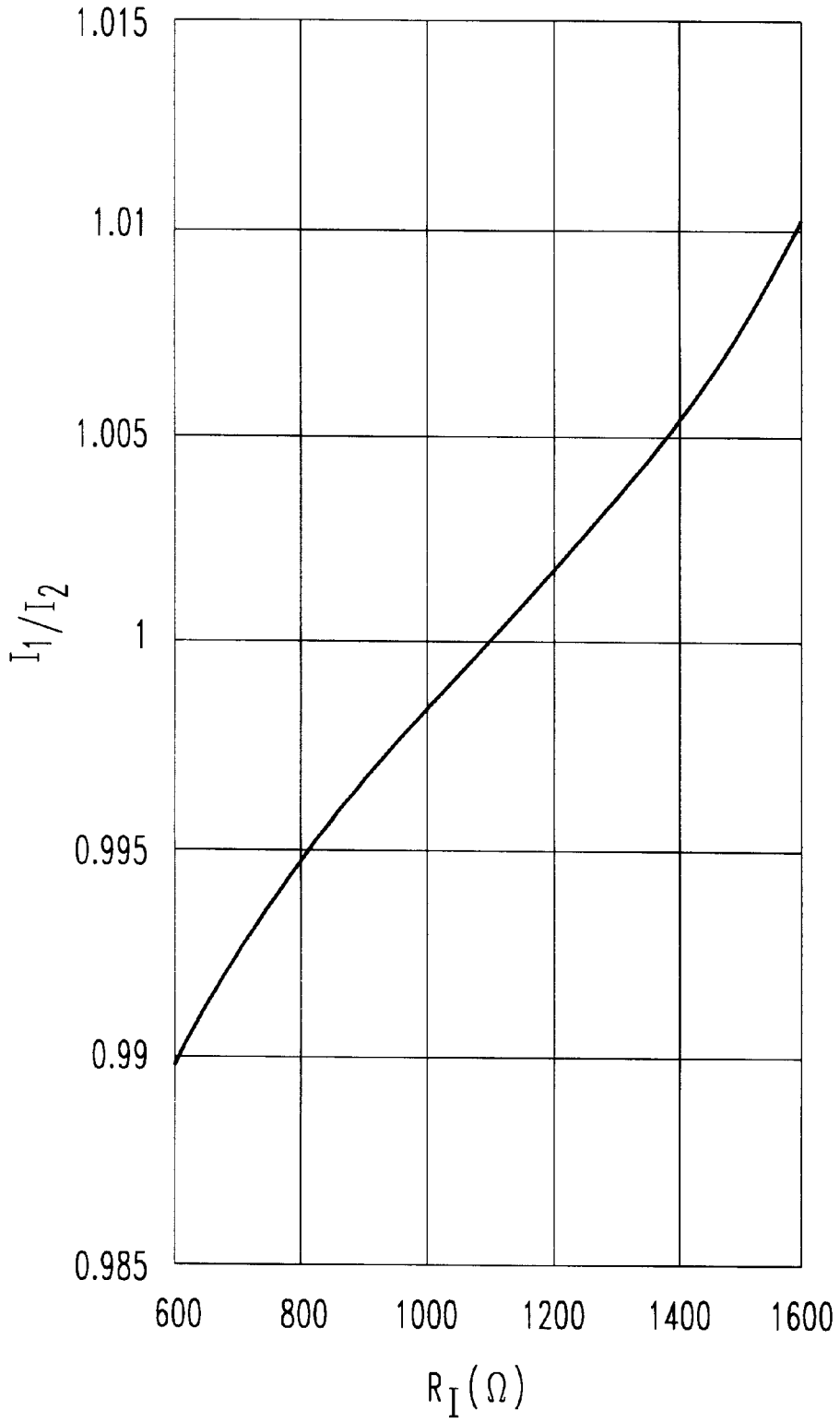
FIG. 3 is a graph in which the ratio $I_1/I_2$ of currents flowing into coils shown in FIG. 2 are plotted against the sum $R_1$ of the resistance of a portion of a first potentiometer 18 on the side of a first fixed resistor 19 and the resistance of the first resistor 19.

It is assumed that $r_1=r_2=10\Omega$, the resistance of the first potentiometer 18=1000Ω, and the resistance of the first and second fixed resistors 19, 20 is 600Ω. The current ratio $I_1/I_2$ at which the sum resistance $R_1$ is balanced against the strength of the magnetic field varies as shown in FIG. 3, the sum resistance $R_1$ being the sum of the resistance of the first fixed resistor 19 and the resistance of the portion of the first potentiometer 18 on the side of the first fixed resistor 19.

Similarly, let $r_3$ be the sum of the resistances of the fifth coil 22 and the sixth coil 23. Let $r_4$ be the sum of the resistances of the seventh resistor 24 and the eighth resistor 25. Let $R_3$ be the sum of the resistance of the third fixed resistor 28 and the resistance of the portion of the second potentiometer 27 between the second sliding contact 30 and the third fixed resistor 28. Let $R_4$ be the sum of the resistance of the fourth fixed resistor 29 and the resistance of the portion of the second potentiometer 27 between the second sliding contact 30 and the fourth fixed resistor 29. Let $I_3$ be the current flowing through the fifth coil 22 and the sixth coil 23. Let $I_4$ be the current flowing through the seventh coil 24 and the eighth coil 25. The ratio of the current $I_3$ to the current $I_4$ is given by $$\frac{I_3}{I_4} = \frac{1 + \frac{r_4}{R_4}}{1 + \frac{r_3}{R_3}} \quad (2)$$

The magnitude of the distortion of the image is varied by varying these current ratios $I_1/I_2$ and $I_3/I_4$. At the same time, the relation between the direction of electrons e entering the spectrometer 8 and the direction of the electrons e going out of the spectrometer 8 varies.

Figure 4:
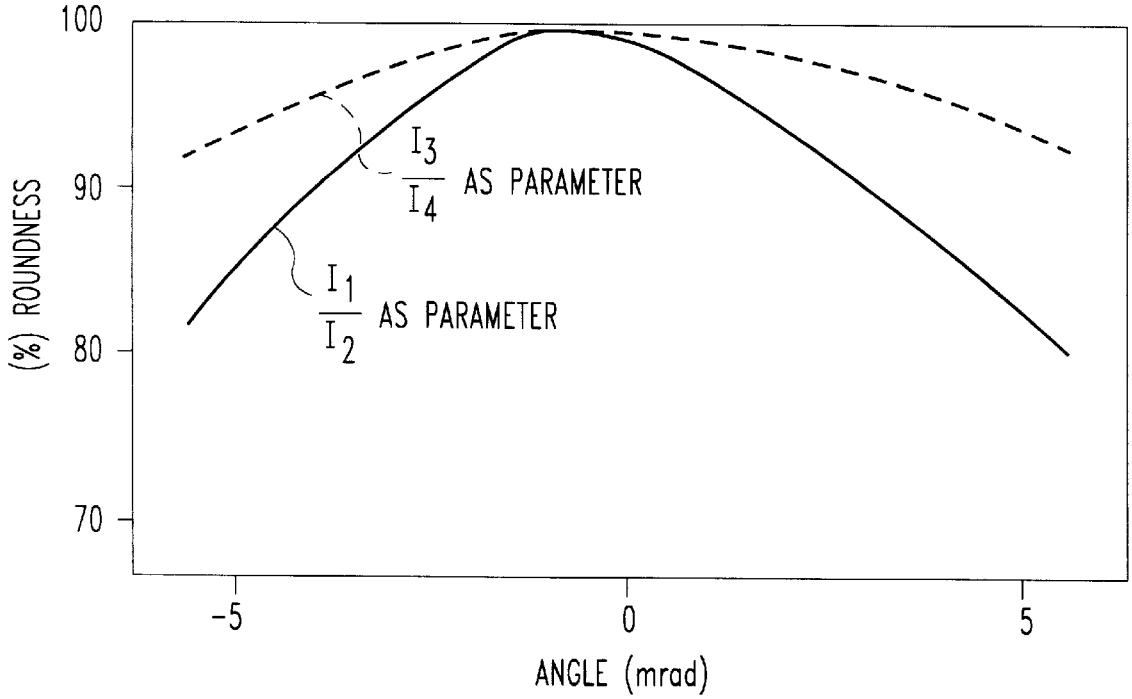
FIG. 4 is a graph in which the roundness representing image distortion is plotted against the angle formed between the direction of incident electrons and the direction of outgoing electrons.
Figure 5:
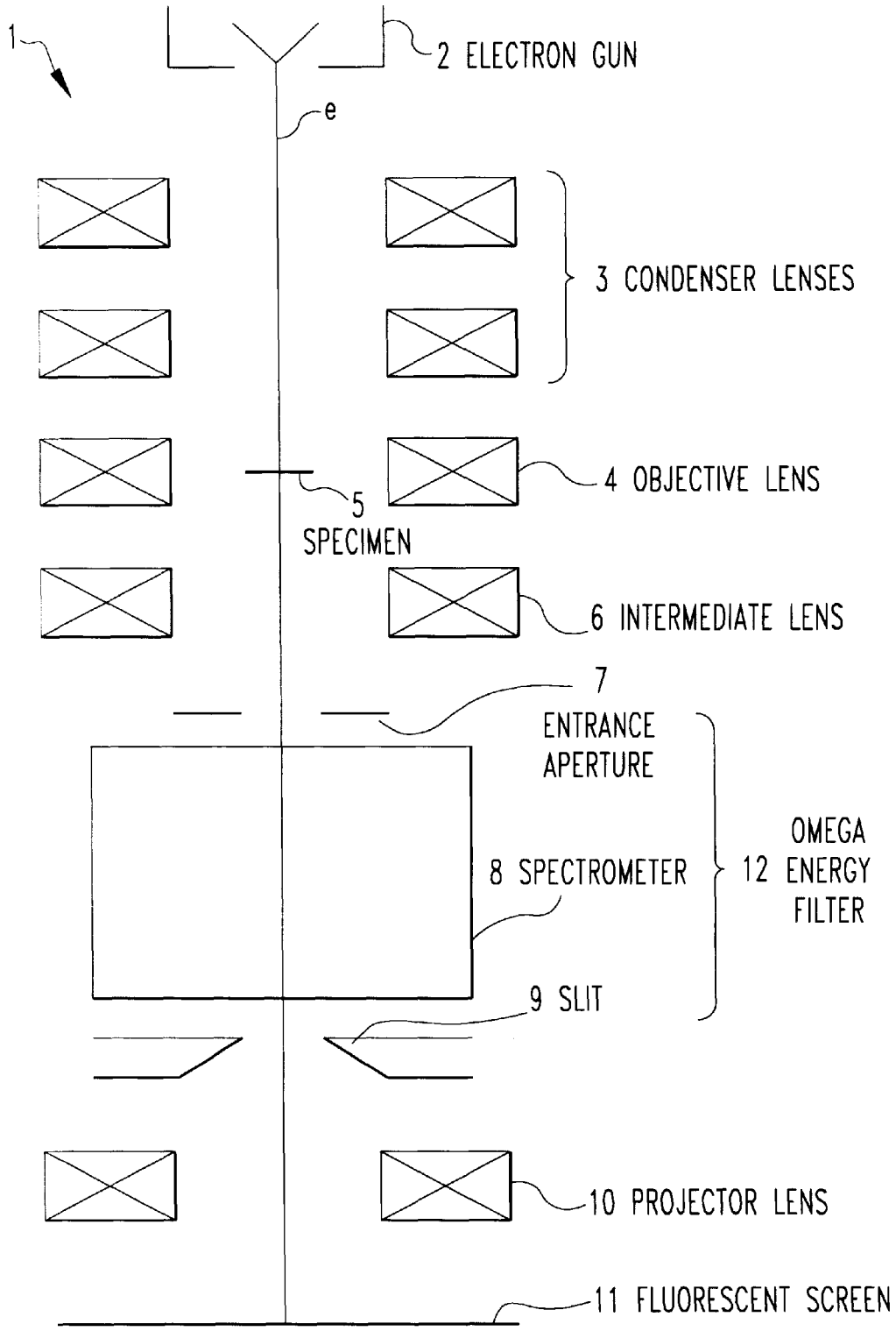
FIG. 5 PRIOR ART
FIG. 5 is a block diagram of the prior art electron microscope having electron optics equipped with an Omega energy filter.
Figure 6:
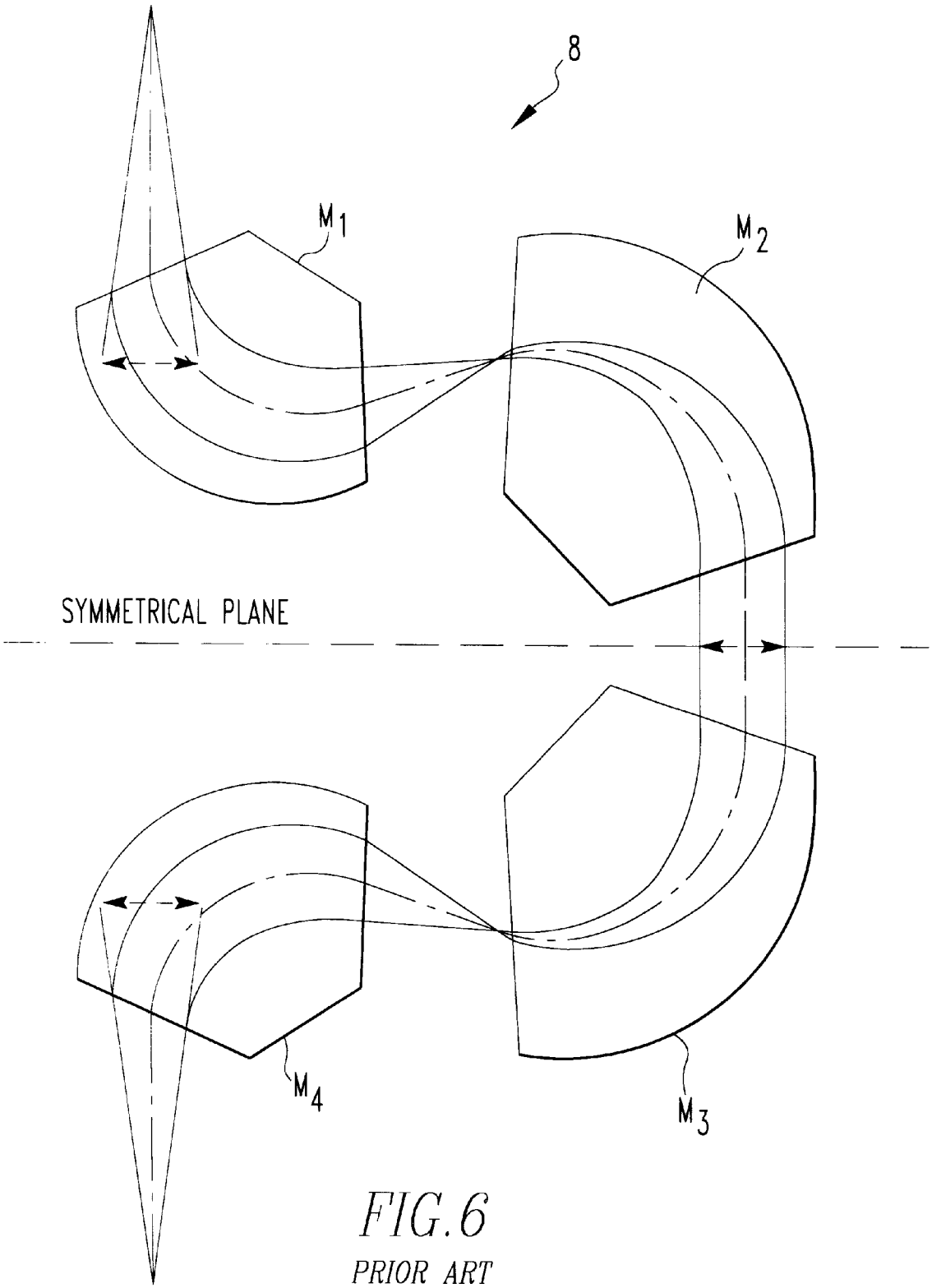
FIG. 6 PRIOR ART
FIG. 6 is a ray diagram of another spectrometer for use with a distortion corrector in accordance with the present invention.

The image distortion is expressed in terms of roundness (%). The relation of the roundness (%) to the angle (mrad) made between the direction of incident electrons and the direction of outgoing electrons is shown in FIG. 4 using the current ratios $I_1/I_2$ and $I_3/I_4$ as parameters. As can be seen from the graph of FIG. 4, the ratio $I_1/I_2$ is more sensitive to the roundness than the angle between the incident and exit directions. The ratio $I_3/I_4$ is more sensitive to the angle between the incident and exit directions than the roundness.

Accordingly, the image distortion and the angle between the incident and exit directions can be accurately corrected as follows. The resistance of the first potentiometer 18 is varied to control the ratio $I_1/I_2$, thus correcting the roundness or the image distortion. The resistance of the second potentiometer 27 is varied to control the ratio $I_3/I_4$, thus correcting the angle between the incident and exit directions, i.e., the astigmatism. These operations are repeated. In this manner, correction of the image distortion and correction of the angle between the incident and exit directions can be accomplished simultaneously by using only two power supplies 17 and 26 for the four magnets $M_1$, $M_2$, $M_3$ and $M_4$.

Furthermore, in this example of an imaging energy filter corrector, the balance between the power supplies can be controlled accurately and easily. In addition, it is not necessary to subtly control the interlocking operation between the power supplies.

In addition, the number of power supplies is fewer. Therefore, the circuit configuration is simplified. Further, the cost can be reduced. Moreover, the distortion in the spectrometer 8 can be corrected accurately. Hence, the distortion can be corrected without using deflection coils that have been used in the past.

When the voltage for accelerating the electrons e or the magnification of the image is varied, or when the imaging mode is selected between image observation mode and diffraction pattern mode, a value giving optimum balance between the currents must be automatically switched. For this purpose, a storage device for storing values giving the optimum balance and a switching circuit can be provided.

Figure 7:
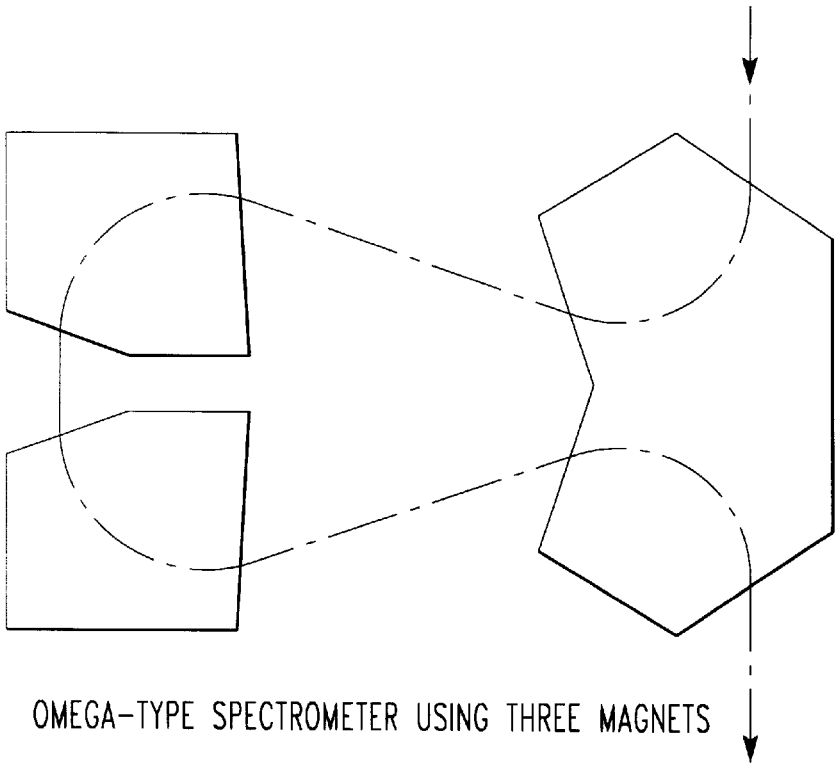
FIG. 7 is a ray diagram of other spectrometers with which a distortion corrector in accordance with the present invention is used.
Figure 7:
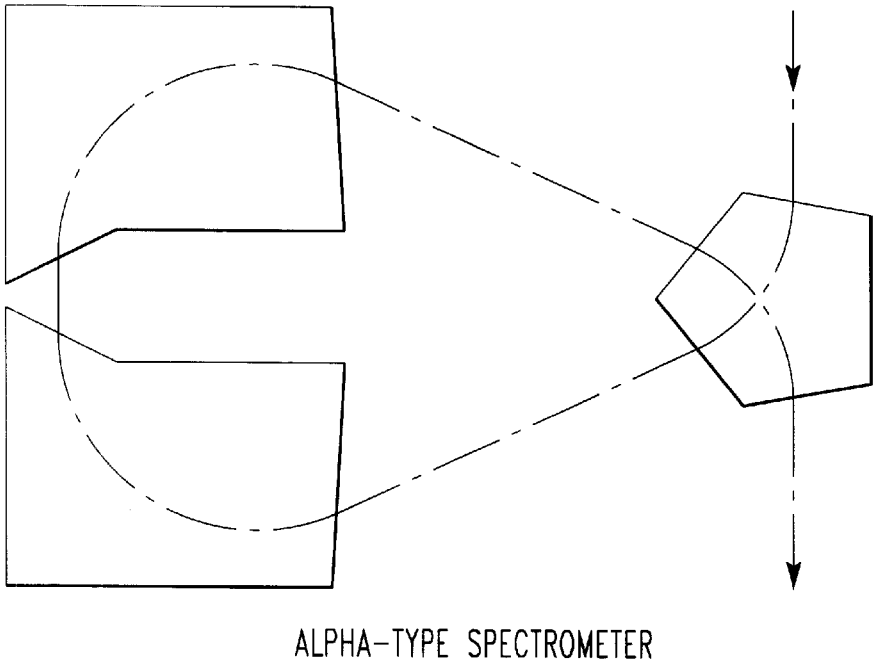

In the embodiment described above, the present invention is applied to an omega-type spectrometer 8 using four magnets. It is to be understood that the invention is not limited to this. For example, the invention can be applied to the omega type which has three magnets, the alpha type as shown in FIG. 7 and other types of imaging energy filter spectrometers using three or more magnets.

As can be understood from the description provided thus far, a distortion corrector for use in an imaging energy filter in accordance with the present invention uses less power supplies than magnets but is capable of correcting image distortion and astigmatism accurately. The reduction in the number of the power supplies makes it possible to control the balance between the power supplies accurately and easily. Furthermore, it is not necessary to subtly control the cooperative operations of the power supplies. Furthermore, the circuit configuration can be simplified and the cost can be decreased because the number of the power supplies is reduced. In addition, the distortion of the spectrometer can be corrected accurately and so the distortion can be corrected without using deflection coils which have been used in the past.

Having thus described our invention with the detail and particularity required by the Patent Laws, what is desired protected by Letters Patent is set forth in the following claims.

What is claimed is:

1. An imaging energy filter having at least three magnets arranged in plane symmetry, said energy filter acting to permit only incident electrons which have a certain energy to exit from said energy filter, said imaging energy filter equipped with a distortion corrector comprising:

said magnets including at least one pair of magnets arranged symmetrically about a symmetrical plane;

coils for exciting said magnets arranged symmetrically, said coils being connected in series at a junction;

a power supply for supplying a current to said series-connected coils; and a potentiometer consisting of a variable resistor and having a sliding contact, said potentiometer being connected in parallel with said coils, said sliding contact being connected with the junction of said coils to form a shunting circuit.

2. The imaging energy filter of claim 1, wherein said potentiometer is connected with said coils via first and second fixed resistors used to prevent overcurrents.

3. An imaging energy filter having first, second, third and fourth magnets arranged in plane symmetry, said energy filter acting to permit only incident electrons which have a certain energy to exit from said energy filter, said imaging energy filter equipped with a distortion corrector comprising:

said first and fourth magnets being arranged symmetrically about a symmetrical plane;

said second and third magnets being arranged symmetrically about said symmetrical plane;

a first pair of coils for exciting said first and fourth magnets arranged symmetrically, said first pair of coils being connected in series at a first junction;

a second pair of coils for exciting said second and third magnets arranged symmetrically, said second pair of coils being connected in series at a second junction;

a first power supply for supplying a current to said first pair of coils being series-connected;

a second power supply for supplying a current to said second pair of coils being series-connected;

a first potentiometer consisting of a first variable resistor and having a first sliding contact, said first potentiometer being connected in parallel with said first pair of coils, said first sliding contact being connected with said first junction of said first pair of coils to form a shunting circuit; and a second potentiometer consisting of a second variable resistor and having a second sliding contact, said second potentiometer being connected in parallel with said second pair of coils, said second sliding contact being connected with said second junction of said second pair of coils to form a shunting circuit.

4. The imaging energy filter of claim 3, wherein said first potentiometer is connected with said first pair of coils via first and second fixed resistors used to prevent overcurrents and said second potentiometer is connected with said second pair of coils via third and fourth fixed resistors used to prevent overcurrents.

5. The imaging energy filter of claim 3 or 4, wherein said each coil consists of a pair of coils connected in series.

* * * * *

UNITED STATES PATENT AND TRADEMARK OFFICE

CERTIFICATE OF CORRECTION

PATENT NO : 6,140,642
DATED : October 31, 2000
INVENTOR(S) : Toshikatsu Kaneyama et al.

It is certified that error appears in the above-identified patent and that said Letters Patent is hereby corrected as shown below:

Title Page, refer to [30] Foreign Application Priority Data, "10-045459" should read --10-045159--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*